US009085833B2

(12) United States Patent
Ichikawa et al.

(10) Patent No.: US 9,085,833 B2
(45) Date of Patent: Jul. 21, 2015

(54) POLYESTER MONOFILAMENT AND METHOD FOR PRODUCING POLYESTER MONOFILAMENT

(75) Inventors: Tomoyuki Ichikawa, Mishima (JP); Hirofumi Yamamoto, Mishima (JP); Hiroyuki Kurokawa, Osaka (JP)

(73) Assignee: Toray Industries, Inc., Tokyo (JP)

( * ) Notice: Subject to any disclaimer, the term of this patent is extended or adjusted under 35 U.S.C. 154(b) by 674 days.

(21) Appl. No.: 13/147,501

(22) PCT Filed: Jan. 27, 2010

(86) PCT No.: PCT/JP2010/051023

§ 371 (c)(1), (2), (4) Date: Aug. 2, 2011

(87) PCT Pub. No.: WO2010/090108

PCT Pub. Date: Aug. 12, 2010

(65) Prior Publication Data

US 2011/0287676 A1 Nov. 24, 2011

(30) Foreign Application Priority Data

Feb. 3, 2009 (JP) ..... 2009-022847

(51) Int. Cl.
*D02J 1/22* (2006.01)
*B41N 1/24* (2006.01)
(Continued)

(52) U.S. Cl.
CPC ..... *D02J 1/228* (2013.01); *B41N 1/247* (2013.01); *B65H 55/04* (2013.01); *D01D 5/16* (2013.01); *D01D 5/34* (2013.01); *D01D 7/00* (2013.01); *D01D 10/02* (2013.01); *D01F 8/14* (2013.01);
(Continued)

(58) Field of Classification Search
CPC ..... D02G 3/00
USPC ..... 428/373, 374, 370, 365; 442/200; 264/105, 130, 210.8, 211.12, 211.14, 264/272.13, 21.8, 211.17
See application file for complete search history.

(56) References Cited

FOREIGN PATENT DOCUMENTS

| | | |
|---|---|---|
| JP | 8267948 | 10/1996 |
| JP | 2001355123 | 12/2001 |
| JP | 200354149 | 2/2003 |
| JP | 2004225224 | 8/2004 |
| JP | 200652493 | 2/2006 |

(Continued)

OTHER PUBLICATIONS

Supplementary European Search Report dated Aug. 16, 2012, application No. EP10738443.

(Continued)

*Primary Examiner* — Lynda Salvatore
(74) *Attorney, Agent, or Firm* — RatnerPrestia

(57) ABSTRACT

A polyester monofilament comprising a high-viscosity polyester as a core component and a low-viscosity polyester as a sheath component is provided, the polyesters having been combined together in a core-sheath arrangement. The polyester monofilament has a fineness of 3.0-13.0 dtex, a breaking strength of 6.0-9.3 cN/dtex, a strength at 10% elongation of 5.0-9.0 cN/dtex, a difference in wet heat stress in the filament-length direction of 3.0 cN or less, and a residual torque value of at most 4 turns per m. Provided is a process for producing a polyester monofilament by a direct spinning/drawing method in which two ingredients, i.e., a high-viscosity polyester as a core component and a low-viscosity polyester as a sheath component, are melt-extruded from a spinnert while being combined together in a core-sheath arrangement, and cooled and solidified, and the resultant extrudate filament is continuously drawn and wound up.

4 Claims, 3 Drawing Sheets

(51) Int. Cl.

| | |
|---|---|
| ***B65H 55/04*** | (2006.01) |
| ***D01D 5/16*** | (2006.01) |
| ***D01D 5/34*** | (2006.01) |
| ***D01D 7/00*** | (2006.01) |
| ***D01D 10/02*** | (2006.01) |
| ***D01F 8/14*** | (2006.01) |

(52) U.S. Cl.
CPC ... *B65H 2701/3132* (2013.01); *Y10T 428/2929* (2015.01); *Y10T 442/10* (2015.04)

(56) References Cited

FOREIGN PATENT DOCUMENTS

| | | |
|---|---|---|
| JP | 2008-101287 | 5/2008 |
| JP | 2008101290 | 5/2008 |
| JP | 2008291385 | 12/2008 |
| WO | WO2008/146690 A1 | 12/2008 |

OTHER PUBLICATIONS

International Search Report for PCT/JP2010/051023 dated Apr. 27, 2010.

POLYESTER MONOFILAMENT AND METHOD FOR PRODUCING POLYESTER MONOFILAMENT

CROSS-REFERENCE TO RELATED APPLICATIONS

This application is the U.S. National Phase application of PCT International Application No. PCT/JP2010/051023, filed Jan. 27, 2010, and claims priority to Japanese Patent Application No. 2009-022847, filed Feb. 3, 2009, the disclosures of which PCT and priority applications are incorporated herein by reference in their entirely for all purposes.

FIELD OF THE INVENTION

The invention relates to a polyester monofilament and a method for producing a polyester monofilament. In particular, the present invention relates to a polyester monofilament suitable for screen mesh cloths for use in precise printing and to a method for producing thereof.

BACKGROUND OF THE INVENTION

Mesh fabrics made of natural fibers such as silk, or inorganic fibers such as stainless wires have been widely used as printing screen mesh cloths. In recent years, however, mesh cloths made of organic fibers such as nylon or polyester fibers have been frequently used, because of their flexibility, durability and dimensional stability. In particular, at present, screen mesh cloths made of polyester monofilaments have been widely used, because they are less affected by water than nylon screen mesh cloths, and relatively inexpensive.

In the current field of electronic circuit printing for home appliances, cellular phones, personal computers, etc., however, the need for an improvement in printing precision becomes demanding. Therefore, there has been a demand for screen mesh cloths having a finer mesh and excellent in dimensional stability that elongation is small during cloth tensioning or the like. Thus, there has been a demand for raw yarns for screen mesh cloths having fine fineness, high strength, and high modulus.

In general, it is known that in order to form high-strength, high modulus polyester fibers, the process of forming raw fibers should include performing high-ratio drawing so that high degrees of orientation and crystallization can be obtained. However, if high-ratio drawing is performed, mechanical strain, namely, stress is generated and accumulated in the fiber due to a sudden structural change. The mechanical strain tends to decrease with time, which is called stress relaxation. When the fiber obtained by high-ratio drawing is wound on a pirn, the stress relaxation often does not uniformly proceed over the pirn package, so that the part where the stress relaxation does not proceed develops gloss anomalies. Such anomalies are called pirn barre.

At present, a screen mesh cloth after weaving is used in printing, after a process including applying an emulsion thereto and subjecting it to exposure and curing so that an electronic circuit can be transferred thereto. Therefore, if halation of the applied light occurs in the process of exposing the emulsion to light and curing the emulsion, printing precision will be reduced. In order to prevent the reduction in printing precision, the fabric is dyed with a light color dye after the weaving so that halation can be reduced. However, the pirn barre portion remains as an abnormal stripe portion even after the dyeing and therefore may reduce the screen mesh cloth quality and cause a gloss difference from the normal portion, which may cause exposure unevenness during the exposure of the emulsion to light. As a result, the quality of the screen mesh cloth, which is reduced in printing precision, is not suitable for high-mesh and high-precision printing.

Snarl associated with polyester monofilaments also causes a problem against the production of high-quality screen mesh cloths for use in precise printing. Generally, in a process of weaving a screen mesh cloth, a batch of about 600 to 800 warp yarns are wound on a warping drum at an unraveling speed of 200 m/minute to 500 m/minute in a partial warping machine. In this warping process, if over unraveling occurs due to temporary stop of operation or the like, "fiber slack" will occur, and filaments will be entangled with one another, which will fixed in the form of a twist yarn. This trouble is so-called snarl. If the operation is started again, the snarl with maintaining its shape will be entangled in the warping drum, which will cause warp breakage during weaving, and the snarl will be partially woven into a mesh cloth, so that the quality of the cloth is significantly reduced. When fine-size polyester monofilaments such as those with a fineness of 13 dtex or less are used, snarl will get worse.

A known conventional method for producing a polyester monofilament includes performing spinning once, winding an undrawn fiber, then subjecting the undrawn fiber to one-step or multi-step drawing at a speed of 500 to 1,500 m/minute using a known drawing machine (draw twister), and winding the drawn fiber into a pirn shape. In a draw twister, however, the winding tension increases due to the friction against travelers, so that the degree of relaxation of the residual shrinkage stress on the yarn is different between the end and the center of the package, which makes it impossible to avoid pirn barre (crosswise stripes with a gloss difference, which are periodically formed in the crosswise direction). Since the fiber is twisted by the drawing machine (draw twister), the problem of snarl also occurs.

There is also a known method including drawing an undrawn fiber using a known drawing machine (draw twister) and winding the drawn fiber into a pirn shape, wherein the pirn package is shaped in such a manner that the ratio of its end area is made as small as possible, so that the difference in residual shrinkage stress on yarn between the end and the center of the package can be reduced and that pirn barre can be avoided. Unfortunately, this method, which is substantially one-step drawing, cannot produce a high-strength and high-modulus polyester monofilament. In addition, since the fiber is twisted by the drawing machine (draw twister), the problem of snarl also occurs.

A known method for producing a polyester monofilament includes a so-called direct spinning-drawing method, in which a spun undrawn fiber is directly subjected drawing and winding without being temporarily wound. There has been proposed a method that includes operating, at a speed of 3,000 m/minute or more, a stretching system including a tension applying roll, a heated supply roll, a heated stretching roll, and a non-heated godet roll; and stretching the yarn by 0.1% to 10% between the heated stretching roll and the non-heated godet roll (Patent Literature 1). There is also proposed another method in which pirn winding is performed after direct spinning-drawing is performed by the same method (Patent Literature 2). Unfortunately, these methods, which are both substantially one-step drawing, cannot produce a high-strength and high-modulus polyester monofilament as desired according to the present disclosure. In addition, these methods cannot achieve both high modulus and uniform relaxation of stress, namely, prevention of pirn barre, as desired according to the present disclosure.

There is proposed a method of producing a polyester monofilament by direct spinning-drawing, which includes extruding a polyester monofilament from a spinneret, solidifying it by cooling, then applying a finishing agent (oil agent) to the polyester monofilament yarn, feeding the yarn at 300-800 m/minute, and then subjecting the yarn to multi-step drawing without winding the undrawn yarn temporarily, after the yarn is allowed to pass through three or more hot rolls sequentially (Patent Literature 3). Unfortunately, this method has a problem in which the production of a high-modulus monofilament with a fine fineness such as a fineness of 13 dtex or less suffers from fiber falling during winding, namely, a reduction in yarn-making ability, deterioration of package, and unraveling failure. This method cannot achieve both high modulus and uniform relaxation of stress, namely, prevention of pirn barre, as desired according to the present disclosure.

As described above, conventional techniques have not been able to achieve conflicting goals such as the production of high-strength and high-modulus raw fibers and the prevention of pirn barre.

Therefore, there has been a strong demand for a polyester monofilament that has characteristics necessary for the production of screen mesh cloths for use in precise printing, such as fine fineness, high strength, and high modulus, provides excellent dimensional stability when used to form screen mesh cloths, is free from such a problem as pirn barre or snarl, and provides excellent mesh cloth quality.

PATENT LITERATURE

PTL 1 JP 05-295617 A
PTL 2 JP 2004-225224 A
PTL 3 JP 2009-084712 A

SUMMARY OF THE INVENTION

The present invention provides a polyester monofilament that has fine fineness, high strength, and high modulus, provides excellent dimensional stability when used to form screen mesh cloths, is free from such a problem as pirn barre or snarl, and provides excellent mesh cloth quality.

The present invention also provides a method for producing a polyester monofilament, which makes it possible to produce an excellent polyester monofilament stably in a process in which yarn breakage is less likely to occur.

One aspect of the present invention provides a polyester monofilament, containing a core component of a high-viscosity polyester and a sheath component of a low-viscosity polyester, which form a core-sheath type bicomponent structure; and having a fineness of 3.0 to 13.0 dtex, a breaking strength of 6.0 to 9.3 cN/dtex, a strength of 5.0 to 9.0 cN/dtex when elongated by 10%, a wet-heat stress difference of 3.0 cN or less in the fiber longitudinal direction, and a residual torque value of 4 twists/m or less.

Another aspect of the present invention provides a method for producing a polyester monofilament, containing:

producing a polyester monofilament by a direct spinning-drawing process including producing a core-sheath type composite from two components of a high-viscosity polyester for a core component and a low-viscosity polyester for a sheath component, extruding a melt of the composite from a spinneret, cooling the melt to solidify it, then continuously drawing the resulting undrawn yarn, and winding the yarn, wherein the high-viscosity polyester for forming the core component has an intrinsic viscosity of 0.70 to 2.00, the low-viscosity polyester for forming the sheath component has an intrinsic viscosity of 0.40 to 0.70, and there is a difference of 0.20 to 1.00 between the intrinsic viscosities of the core component polyester and the sheath component polyester, the undrawn yarn is drawn 4.0 to 7.0 times by a multi-step drawing process with three or more sets of hot rolls, and then the drawn yarn is relaxed by −2% to 8% between a final hot roll and a non-heated godet roll, the yarn heat-treated with the final hot roll is wound through two or more non-heated godet rolls, the yarn is wound into a package on a bobbin attached to a spindle in such a manner that the package is tapered at both ends, wherein the spindle is placed so that its rotation axis is perpendicular to the running direction of the yarn running from the non-heated godet roll, and the spindle is allowed to traverse in the direction of its rotation axis, the yarn is wound into a pirn package form that satisfies the formula: $0.1\ L \leq Lt \leq 0.4\ L$, wherein L represents the length of a portion where the yarn is wound in the pirn, and Lt represents the length of the tapered portion of the pirn package, and winding tension is controlled to be from 0.1 to 0.4 cN/dtex.

Using the polyester monofilament provided by the present invention having fine fineness, high strength, and high modulus, as a screen mesh cloth, the mesh cloth becomes excellent in dimensional stability without pirn barre, snarl, etc.

The polyester monofilament provided by the present invention is suitable for use in precise printing screen mesh cloths, which has not been achieved by conventional techniques. The screen mesh cloth produced with the polyester monofilament provided by the present invention is suitable for use in applications requiring higher-quality, higher-mesh screen cloths, for example, high-precision printing of graphic design products such as compact disc labels, and electronic board circuits.

The method for producing a polyester monofilament according to one aspect of the present invention makes it possible to produce a polyester monofilament that is suitable for high-mesh screen cloths having excellent dimensional stability by high strength and high modulus, being free from such a problem as pirn barre or snarl, having excellent quality, and being suitable for high-precision screen printing. The method for producing a polyester monofilament according to the present invention provides a method for producing a polyester monofilament, which is stable in a process in which yarn breakage is less likely to occur.

DETAILED DESCRIPTION OF THE INVENTION

Figure 1:
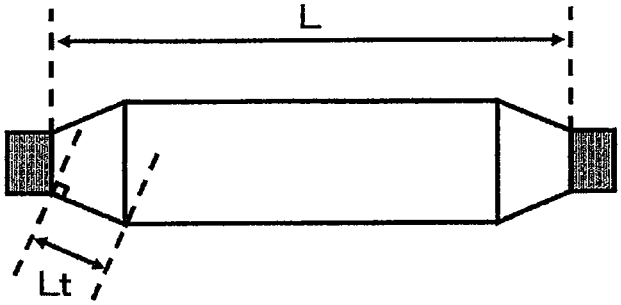
FIG. 1 is a diagram showing an example of the pirn package shape according to an embodiment of the present invention.

A description is given of embodiments of the polyester monofilament of the present invention.

The polyester monofilament of an embodiment of the present invention is a core-sheath type bicomponent polyester monofilament containing a core component covered with a sheath component in the cross-section, wherein the sheath component is placed so that the core component is not exposed to the surface.

As the polyester of the polyester monofilament of an embodiment of the present invention, the polyester composed mainly of polyethylene terephthalate (hereinafter referred to as PET) is used.

PET for use in an embodiment of the present invention includes a polyester composed of 90 mol % or more of an ethylene terephthalate repeating unit, in which terephthalic acid is a main acid component and ethylene glycol is a main glycol component. PET for use in an embodiment of the present invention may contain a copolymerized component (s) capable of forming an additional ester bond at a ratio of 10 mol % or less. Examples of the copolymerized component include acid components, for example, bifunctional aromatic carboxylic acids such as isophthalic acid, phthalic acid, dibromoterephthalic acid, naphthalenedicarboxylic acid, and octoethoxybenzoic acid, bifunctional aliphatic carboxylic acids such as sebacic acid, oxalic acid, adipic acid, and dimer acid, and dicarboxylic acids such as cyclohexanedicarboxylic acid; and glycol components, for example, ethylene glycol, diethylene glycol, propanediol, butanediol, neopentyl glycol, bisphenol A, cyclohexane dimethanol, polyoxyalkylene glycols such as polyethylene glycol and polypropylene glycol, and the like.

In the polyester monofilament of an embodiment of the present invention, if necessary, titanium dioxide as a delustering agent, silica or alumina fine particles as a lubricant, a hindered phenol derivative as an antioxidant, and other additives such as a flame retardant, an antistatic agent, an ultraviolet absorbing agent, a color pigment, and the like may be added to PET.

The amount of inorganic particles added to PET in the core component of the polyester monofilament of an embodiment of the present invention is preferably less than 0.5 wt %. On the other hand, inorganic particles are preferably added in an amount of 0.1 wt % to 0.5 wt % to PET in the sheath component in order to improve the wear resistance of the polyester monofilament.

In order for the polyester monofilament to have good scumming resistance, the polyester used in the sheath component preferably has an intrinsic viscosity lower than that of the polyester used in the core component, and the difference between them is preferably from 0.20 to 1.00.

In the polyester monofilament, the intrinsic viscosity of the polyester used in the sheath component is preferably made lower than the intrinsic viscosity of the core component polyester, so that the generation of a scum is reduced.

The process of manufacturing a screen mesh cloth, in which a high-density fabric is formed by high-speed weaving, is exposed to a very large number of strong frictions with reeds or the like, so that the filament surface is partially abraded together with crystallization of the surface, which sometimes causes the generation of whisker-like or powdery refuses, so-called scums. The scums even in a small amount are scattered into the weaving machine, and there is a risk that they may be partially woven into the screen mesh cloth. Therefore, the generation of scums should preferably be prevented. In the polyester monofilament of an embodiment of the present invention, the difference between the intrinsic viscosity of the polyester used in the sheath component and the intrinsic viscosity of the core component polyester is preferably 0.20 or more, which makes it possible to reduce the degrees of orientation and crystallization of the sheath component polyester, namely, the surface of the polyester monofilament, so that a higher level of scumming resistance can be obtained.

When the difference between the intrinsic viscosity of the polyester used in the sheath component and the intrinsic viscosity of the core component polyester is preferably 0.20 or more in the polyester monofilament, the spinneret-inner-wall shear stress is taken by the sheath component during melt spinning, and therefore the shear stress applied to the core component becomes small, so that the core component is spun in a uniform state with a low degree of molecular chain orientation. Therefore, the finally resulting polyester monofilament tends to have the improved strength thereof. More preferably, the difference between the intrinsic viscosities of the polyesters is from 0.30 to 0.70.

In the polyester monofilament of an embodiment of the present invention, the high-viscosity polyester in the core component preferably has an intrinsic viscosity of 0.70 to 2.00. In addition, when the intrinsic viscosity is 0.70 or more, a polyester monofilament having sufficient strength and extensibility can be produced. More preferably, the intrinsic viscosity is 0.80 or more. In view of easiness of forming melt extrusion and the like, the intrinsic viscosity preferably has an upper limit of 2.00 or less. Also taking into account the manufacturing cost and the effect of molecular weight reduction caused by molecular chain breakage due to heat or shearing force during the process, the intrinsic viscosity is more preferably 1.50 or less.

When the low-viscosity polyester in the sheath component preferably has an intrinsic viscosity of 0.40 or more, the polyester monofilament having stable yarn-making ability can be obtained. More preferably, the intrinsic viscosity is 0.50 or more. In order to obtain good wear resistance, namely, good scumming resistance, the intrinsic viscosity of the low-viscosity polyester is preferably 0.70 or less.

The polyester monofilament of an embodiment of the present invention has a fineness in the range of 3.0 dtex to 13.0 dtex. In order to obtain a high-mesh screen cloth of 400 mesh or more (mesh: the number of yarns per inch (2.54 cm)) suitable for precision printing, the fineness should be 13.0 dtex or less. Conventional screen mesh cloths with a moderate mesh number are of 120 meshes to 300 meshes, and polyester monofilaments with a fineness of 15 to 25 dtex are used to form them. In the case of a high-mesh screen cloth of 400 meshes or more, however, the mesh grid space per yarn is very small. Therefore, if polyester monofilaments with a fineness of 15 to 25 dtex are used, the opening (aperture) per grid will become very small, so that scums can be generated by friction between reeds and polyester monofilaments and as a result, a screen mesh cloth of 400 mesh or more cannot be obtained. Therefore, the fineness of the polyester monofilament of an embodiment of the present invention has an upper limit of 13.0 dtex. For a screen mesh cloth of 450 meshes or more, the polyester monofilament should preferably have a fineness of 8.0 dtex or less, and for a screen mesh cloth of 500 meshes or more, the polyester monofilament should preferably have a fineness of 6.0 dtex or less. The lower limit of the fineness is 3.0 dtex or more, more preferably 4.0 dtex or more, in view of fabric-forming properties, particularly, in view of weft yarn feeding in a sulzer weaving machine.

Next, a description is given of the physical properties of the polyester monofilament according to embodiments of the present invention.

Screen printing is generally performed using a method in which the tension for cloth tensioning is kept high and the distance between the screen meth cloth and the printing material is made small so that printing pattern precision can be improved. In order to increase the tension for cloth tensioning, it is necessary to increase the tenacity per polyester monofilament.

There are also strict requirements in the printing industry, and therefore, fine-size and high-mesh fabrics, namely, mesh fabrics with high yarn density are advantageous. To obtain high-mesh fabrics with high yarn density, the tenacity per polyester monofilament is preferably high, and the thinner the filament is, the higher the breaking strength is needed.

The polyester monofilament of an embodiment of the present invention has a breaking strength of 6.0 cN/dtex or more and has a strength (modulus) of 5.0 cN/dtex or more when elongated by 10%. When the breaking strength is 6.0 cN/dtex or more and the 10% elongation strength (modulus) is 5.0 cN/dtex or more, the monofilament has high tenacity suitable for high-precision printing, which makes it possible to suppress a reduction in fabric-forming properties and cloth elongation, or the like, and to obtain high dimensional stability. In order to further increase the tension for cloth tensioning and to enable more precise printing, the breaking strength is preferably 7.0 cN/dtex or more, and more preferably 8.0 cN/dtex or more.

The 10% elongation strength (modulus) is preferably 6.0 cN/dtex or more, and more preferably 7.0 cN/dtex or more.

On the other hand, the degree of orientation or crystallization should be reduced for scumming resistance, and therefore, the breaking strength is 9.3 cN/dtex or less, and preferably 9.0 cN/dtex or less.

The 10% elongation strength (modulus) is 9.0 cN/dtex or less, and preferably 8.7 cN/dtex or less.

The polyester monofilament of an embodiment of the present invention has a stress difference of 3.0 cN or less when it undergoes wet heat shrinkage in the fiber longitudinal direction.

If high-ratio drawing is performed in order to obtain a polyester monofilament for screen mesh cloths with high strength and high modulus required in an embodiment of the present invention, sudden structural changes may occur to cause stress inside the fiber, and such stress may fail to be uniformly relaxed on a pirn, so that the stress difference may cause pirn barre. The state of the relaxed stress can be observed by measuring the stress generated when the fiber undergoes wet heat shrinkage. The fact that a difference in stress is observed along the fiber longitudinal direction during wet heat shrinkage indicates that stress relaxation proceeds in a part, while it does not proceed in another part. If the stress difference, specifically, the stress difference during wet heat shrinkage in the fiber longitudinal direction exceeds a certain limit, specifically, 3.0 cN, pirn barre occurs, so that screen mesh cloth quality is reduced. Therefore, the stress difference during wet heat shrinkage in the fiber longitudinal direction is reduced to 3.0 cN or less, pirn barre can be successfully reduced, which makes it possible to obtain a raw yarn for screen mesh cloths, which is suitable for high-quality, precise printing, has excellent dimensional stability as desired, and does not have a quality problem such as pirn barre. The stress difference is preferably further reduced to 2.0 cN or less, a higher effect of suppressing pirn barre can be obtained.

The polyester monofilament of an embodiment of the present invention shows a residual torque value of 4 twists/m or less in a residual torque test. If the residual torque value is more than 4 twists/m, unraveling snarl occurs in a warping process, so that the polyester monofilament becomes entangled in a warping drum, which makes it difficult or impossible to achieve a high-quality screen mesh cloth. The lower, namely, the closer to 0 the residual torque value obtained in a residual torque test is, the more preferable, and therefore, it is preferably 3 twists/m or less, more preferably 2 twists/m or less.

Next, a description is given of the shape of the polyester monofilament of embodiments of the present invention.

The polyester monofilament of an embodiment of the present invention is a core-sheath type bicomponent polyester monofilament having a cross-section containing a core component covered with a sheath component, in which the sheath component is placed so that the core component is not exposed to the surface. In the core-sheath type structure, the core component only has to be covered with the sheath component completely, and they do not always have to be concentrically arranged. While the cross-sectional shape may be any of various shapes such as a circle, a flat shape, a triangle, a rectangle, and a pentagon, a circular cross-section is preferred because of easy achievement of stable yarn-making ability and high-order workability, and of stable opening of screen mesh cloth, and the like.

In an embodiment of the present invention, to achieve both a scum-preventing effect by the sheath component and an increase in strength by the core component, the composite ratio of the core component to the sheath component is preferably in the range of 60:40 to 95:5, more preferably in the range of 70:30 to 90:10.

In an embodiment of the present invention, the composite ratio is defined as the ratio between the cross-sectional areas of two polyesters, which form the polyester monofilament, in a photograph of the cross-section of the polyester monofilament.

Using the polyester monofilament of the present invention, an excellent screen mesh cloth having excellent dimensional stability can be formed without pirn barre, snarl, and the like. The polyester monofilament of the present invention has fine fineness, high strength, and high modulus. Using the polyester monofilament of the present invention, an excellent screen mesh cloth having excellent dimensional stability can be formed without pirn barre, snarl, and the like. Therefore, the screen mesh cloth produced with the polyester monofilament of the present invention is suitable for use in applications requiring higher-quality, higher-mesh screen cloths, for example, high-precision printing of graphic design products such as compact disc labels, and electronic board circuits.

When used to form a screen mesh cloth, the polyester monofilament of the present invention may be used alone to form a warp yarn or a weft yarn or may be used in combination with any other fiber to form different warp and weft yarns.

Next, a description is given of the method for producing a polyester monofilament according to embodiments of the present invention.

The present invention provides a method for producing a polyester monofilament by a direct spinning-drawing process including producing a core-sheath type composite from two components including a high-viscosity polyester for a core component and a low-viscosity polyester for a sheath component, extruding a melt of the composite from a spinneret, cooling the melt to solidify it, then continuously drawing the resulting undrawn yarn, and winding the yarn.

In the method for producing a polyester monofilament according to an embodiment of the present invention, the high-viscosity polyester for forming the core component has an intrinsic viscosity of 0.70 to 2.00, the low-viscosity polyester for forming the sheath component has an intrinsic viscosity of 0.40 to 0.70, and there is a difference of 0.20 to 1.00 between the intrinsic viscosities of the core component polyester and the sheath component polyester.

In the method for producing a polyester monofilament according to an embodiment of the present invention, the high-viscosity polyester for the core component has an intrinsic viscosity of 0.70 to 2.00. When the intrinsic viscosity is 0.70 or more, a polyester monofilament having sufficient strength and extensibility can be produced. More preferably, the intrinsic viscosity is 0.80 or more. In view of easiness of forming such as melt extrusion, the intrinsic viscosity has an upper limit of 2.00 or less. Also taking into account the production cost and the effect of molecular weight reduction caused by molecular chain breakage due to heat or shearing force during the process, the intrinsic viscosity is preferably 1.50 or less.

In the method for producing a polyester monofilament according to an embodiment of the present invention, if the low-viscosity polyester for the sheath component has an intrinsic viscosity of 0.40 or more, stable yarn-making ability can be obtained. Preferably, the intrinsic viscosity is 0.50 or more. In order to obtain good wear resistance, specifically, good scumming resistance, the intrinsic viscosity of the low-viscosity polyester is 0.70 or less.

In the method for producing a polyester monofilament according to an embodiment of the present invention, there is a difference of 0.20 or more between the intrinsic viscosity of the polyester used for the sheath component and the intrinsic viscosity of the core component polyester. According to this feature, the spinneret-inner-wall shear stress is taken by the sheath component during melt spinning, and therefore the shear stress applied to the core component becomes small, so that the core component is spun in a uniform state with a low degree of molecular chain orientation. Therefore, the finally resulting polyester monofilament has improved strength. Preferably, the difference between the intrinsic viscosities of the polyesters is from 0.30 to 0.70.

In the method for producing a polyester monofilament according to an embodiment of the present invention, by making a difference between the intrinsic viscosity of the polyester used for the sheath component and that of the core component polyester to be 0.20 or more, it is possible to reduce the degrees of orientation and crystallization of the sheath component polyester, namely, the surface of the polyester monofilament, so that a higher level of scumming resistance can be obtained.

In the method for producing a polyester monofilament according to an embodiment of the present invention, the undrawn yarn is drawn 4.0 to 7.0 times by a multi-step drawing process with three or more sets of hot rolls.

In an embodiment of the present invention, multi-step drawing includes a process of drawing an undrawn yarn 4.0 to 7.0 times using a multi-step combination of hot rolls varying in speed.

In order to produce a polyester monofilament with high strength and high modulus, it is advantageous to draw an undrawn yarn at high ratio. If high-ratio, one-step drawing is performed with two sets of hot rolls, drawing tension increases so that a problem such as an increase in yarn unevenness or yarn breakage occurs frequently. Therefore, high-ratio drawing should be performed using a combination of multi-step rolls. In view of cost, equipment space, and operability, three to six sets of hot rolls are preferably used. Any of a set of one hot roll and one separate roll and a set of two hot rolls (so called duo-type) may be used. Two hot rolls count as one set.

In an embodiment of the present invention, the total draw ratio in the multi-step drawing is 4.0 times to 7.0 times. If the draw ratio is less than 4.0 times, the resulting drawn yarn has a fiber structure with a low degree of orientation, so that a high-strength polyester monofilament cannot be obtained. If the draw ratio is more than 7.0 times, drawing tension is extremely high so that yarn breakage frequently occurs, which not only reduces the yarn-making ability but also causes worse pirn barre due to an increase in residual stress. The draw ratio on the multi-step drawing is form 4.0 to 7.0 times, more preferably from 4.5 to 6.5 times, even more preferably from 5.0 to 6.0 times.

In the method for producing a polyester monofilament according to an embodiment of the present invention, after the undrawn yarn is subjected to the multi-step drawing, the drawn yarn is relaxed by −2% to 8% between the final hot roll and a non-heated godet roll.

In an embodiment of the present invention, the relaxation is performed between the final hot roll and a non-heated godet roll by changing the roll speed.

In the method for producing a polyester monofilament according to an embodiment of the present invention, the relax ratio is from −2% to 8%. To obtain a relax ratio of −2% to 8%, the ratio ($V_2/V_1$) of the non-heated godet roll speed ($V_2$) to the final hot roll speed ($V_1$) is set at 0.92 to 1.02. If the relax ratio is less than −2%, the tension between the rolls becomes high so that yarn breakage frequently occurs. If the relax ratio is more than 8%, orientation is reduced in an amorphous part so that a high-modulus polyester monofilament cannot be obtained. More preferably, the relax ratio is in the range of −1% to 3%. In the method for producing a polyester monofilament according to an embodiment of the present invention, the relaxation makes it possible to control the orientation in the amorphous part of the polyester monofilament, specifically, to control the modulus (to increase the modulus).

In the method for producing a polyester monofilament according to an embodiment of the present invention, the yarn heat-treated with the final hot roll is wound through two or more non-heated godet rolls.

To produce a polyester monofilament with high strength and high module, relaxation is performed between the final hot roll and the non-heated godet roll as described above. On the other hand, to prevent pirn barre, the winding tension is preferably as low as possible when the yarn exiting from the non-heated godet roll is wound on a pirn. It is very difficult to take up, under low tension, a fine-size yarn.

In the method for producing a polyester monofilament according to an embodiment of the present invention, therefore, two or more non-heated godet rolls are provided downstream of the final hot roll. When plural non-heated godet rolls are provided between the final hot roll and the winding unit, the physical properties of the filament can be fixed by relaxation between the final hot roll and the non-heated godet roll, and subsequently, the thermoset yarn can be cooled between the two or more non-heated godet rolls, and when there is a difference in speed between the rolls, the fiber structure can be relaxed to a certain level, while the tension can be highly controlled. Therefore, the physical properties do not change between the non-heated godet roll and the winding unit, and the tension on the yarn can be easily controlled, which makes possible, low-tension winding.

In the method for producing a polyester monofilament according to an embodiment of the present invention, the speed of the final godet roll is preferably set higher than the speed of the godet roll upstream of the final godet roll, so that vibration of the yarn caused by low-tension winding is absorbed between the godet rolls. Therefore, the yarn running is stabilized.

When two or more non-heated godet rolls are provided downstream of the final hot roll, the tension between the final hot roll and the non-heated godet roll can be separated from the winding tension, so that relaxation can be performed adequately. Two non-heated godet rolls downstream of the final hot roll may form one set, and the final godet roll may be placed downstream thereof, so that the tensions can be separated from each other.

In this case, the number of godet rolls means the number of godet rolls whose speeds can be set independently, and a set of two rolls count as one.

The surface state of the non-heated godet rolls for use in an embodiment of the present invention is preferably a mirror surface or a slotted mirror surface in order to maintain the yarn holding ability. Textured rolls may also be used.

As used herein, the term "mirror surface" refers to a roll surface with a surface roughness of 1S or less, and the term "textured" refers to a roll surface with a surface roughness of 2 to 4S. The surface roughness corresponds to the maximum height (Rmax) described in JIS B 0601. The mirror surface or the slotted mirror surface makes it possible to hold the yarn efficiently. Therefore, the yarn can stably run while a constant tension is maintained ahead and behind the roll, so that a high-quality product can be easily obtained with small variations in physical properties in the longitudinal direction of the yarn.

In the method for producing a polyester monofilament according to an embodiment of the present invention, the yarn is wound into a package on a bobbin attached to a spindle in such a manner that the package is tapered at both ends, wherein the spindle is placed so that its rotation axis is perpendicular to the running direction of the yarn running from the non-heated godet roll, and the spindle is moved to traverse in the direction of its rotation axis.

If the yarn running from the roll is wound on a package after it is bent by guides (travelers) as in a conventional drawing machine for two-step method, shaving of the yarn frequently occurs. If the winding tension further increases due to the friction against the guides (travelers), pirn barre significantly occurs. In an embodiment of the present invention, therefore, a spindle is placed so that its rotation axis is perpendicular to the running direction of the yarn, and the yarn is wound on a bobbin attached to the spindle, so that shaving of the yarn and pirn barre can be prevented.

When the yarn is wound into a package in such a manner that the package is tapered at both ends, the spindle to which the bobbin is attached is preferably moved to traverse, and the traverse is preferably controlled in such a manner that the traverse width gradually decreases from the start of winding to the end of winding. The traverse is preferably controlled using a controller with sufficiently high position control accuracy, because if the accuracy of the traverse turning position repeatability is low, the yarn may overrun and fall from the end of the package.

In the method for producing a polyester monofilament according to an embodiment of the present invention, the yarn is wound into a pirn package form that satisfies the following formula:

$$0.1\ L \leq Lt \leq 0.4\ L,$$

wherein L represents the length of a portion where the yarn is wound in the pirn, and Lt represents the length of the tapered portion of the pirn package.

In the method for producing a polyester monofilament according to an embodiment of the present invention, pirn winding is performed. As used herein, the term "pirn winding" refers to forming a package tapered at both ends such as shown in FIG. 1, namely, forming a tapered-end package. The term "drum winding" refers to forming a cylindrical package, which is not tapered at both ends.

Pirn winding or drum winding is generally used in fiber winding methods. In the method for producing a polyester monofilament according to an embodiment of the present invention, pirn winding is performed, so that the winding tension can be set low, the stress generated by high-ratio stretching can be easily relaxed, and the package can be stably formed without yarn falling or irregular shape of winding. Therefore, good unraveling ability can be provided in a high-order process, high-order passage can be stabilized, and equipment and operation can be easily adapted to an increase in fine fineness.

The mechanical strain caused by high-ratio stretching, namely, stress starts to relax immediately after the yarn is wound on the bobbin. However, the relaxation does not uniformly occur over the pirn package, but proceeds differently between the tapered portion of the package and the other portion. The stress is more likely to remain at the tapered portion.

In the method for producing a polyester monofilament according to an embodiment of the present invention, for prevention of irregular shape of winding and pirn barre, the pirn package has a shape represented by the formula:

$$0.1\ L \leq Lt \leq 0.4\ L,$$

wherein L represents the length of a portion where the fiber is wound in the pirn, and Lt represents the length of the tapered portion of the pirn package. In order to prevent pirn barre, the pirn package is shaped as defined above by winding so that the residual stress difference is reduced.

When Lt is 0.4 L or less, the effect of preventing pirn barre is obtained. Lt is preferably 0.3 L or less. FIG. 1 shows an example of the pirn package shape according to an embodiment of the present invention.

In the method for producing a polyester monofilament according to an embodiment of the present invention, the winding tension is controlled in the range of 0.1 cN/dtex to 0.4 cN/dtex.

In general, as the winding tension increases, the difference in the degree of relaxation of residual shrinkage stress increases between the end and the center of the pirn package, so that the problem of pirn barre becomes more likely to occur. In an embodiment of the present invention, the winding tension is set at 0.4 cN/dtex or less, so that pirn barre is avoided. In addition, the winding tension is set at 0.1 cN/dtex or more, so that yarn swinging can be reduced between a non-heated godet roll and a winding machine, which makes it possible to wind the yarn stably even at an increased winding speed. The winding tension is more preferably from 0.2 cN/dtex to 0.3 cN/dtex. The winding tension may be controlled using a known winding controller in such a manner that the number of revolutions of the spindle motor to which the bobbin is attached is controlled so that the tension on the running yarn detected by a tension sensor is kept constant.

The method for producing a polyester monofilament according to an embodiment of the present invention makes it possible to produce a polyester monofilament, containing a core component of high-viscosity polyester and a sheath component of low-viscosity polyester, which form a core-sheath type bicomponent structure, and having a fineness of 3.0 to 13.0 dtex, a breaking strength of 6.0 to 9.3 cN/dtex, a strength of 5.0 to 9.0 cN/dtex when elongated by 10%, a wet-heat stress difference of 3.0 cN or less in the fiber longitudinal direction, and a residual torque value of 4 twists/m or less. The method for producing a polyester monofilament according to the present invention makes it possible to produce a polyester monofilament that is suitable for high-mesh screen cloths having excellent dimensional stability derived from high strength and high modulus, being free from such a problem as pirn barre or snarl, having excellent quality, and being suitable for high-precision screen printing.

Methods using a non-heated first godet roll, a first hot roll, a second hot roll, a third hot roll, and two non-heated godet rolls are described in detail as preferred examples of the method for producing a polyester monofilament according to the present invention.

When the polyester monofilament of an embodiment of the present invention is produced by melt spinning, high-viscosity PET as a core component and low-viscosity PET as a sheath component are each preferably melted at a temperature of 280° C. to 300° C. Methods for melting PET include pressure melter methods and extruder methods. In view of uniform melting and prevention of retention, melting is preferably performed by extruder methods.

The separately melted polymers are passed through different pipelines and each dispensed and then fed to a spinneret pack. In this process, the piping travel time is preferably 30 minutes or less to prevent thermal degradation. The high-viscosity PET and the low-viscosity PET fed into the pack are combined in the spinneret to form a core-sheath type bicomponent structure, which is discharged from the spinneret. The spinning temperature is appropriately from 280 to 300° C. When the spinning temperature is from 280 to 300° C., a polyester monofilament can be successfully produced taking advantage of the characteristics of PET.

The spinning and pulling are preferably performed in such a manner that the temperature of the atmosphere immediately below the spinneret is heated and kept at a certain temperature of 260° C. or higher. When the temperature of the atmosphere immediately below the spinneret is heated and kept at a temperature of 260° C. or higher, a spun polyester monofilament with a fineness of 3.0 dtex to 13.0 dtex is not easily cooled even with a small spun yarn size and tends to be easily drawn at high ratio.

The take-up speed of the non-heated godet roll is preferably from 300 m/minute to 1,500 m/minute, more preferably from 500 m/minute to 1,000 m/minute. When the take-up speed of the non-heated godet roll is in the range of 300 m/minute to 1,500 m/minute, high-ratio drawing can be performed without forming undrawn fiber orientation on the spinning line, which makes it possible to obtain a high-strength polyester monofilament with good productivity.

In the drawing and winding process, the spun yarn is subjected to multi-step drawing through a hot roll and a non-heated godet roll, subjected to relaxation, and wound in the form of a pirn.

In the multi-step drawing, temperatures at which fusion between the running yarn and the roll does not occur are preferably used as needed for the hot roll temperature conditions. In general, the first hot roll is preferably set at a glass transition temperature of the core component polyester of +10° C. to 30° C., and the temperature of the second hot roll or later is preferably increased in a gradual manner. A roll or rolls upstream of the final hot roll preferably have a temperature equal to or lower than the temperature of the final hot roll.

The final hot roll preferably has a temperature of 130° C. to 230°. More preferably, the temperature of the final hot roll is in the range of 200° C. to 220° C. When the final hot roll temperature is from 130° C. to 230° C., orientation is easily controlled, so that a high-strength polyester monofilament can be obtained, and the final hot roll is prevented from causing fusion, so that good yarn-making ability can be achieved.

The winding speed is generally from 2,500 to 5,000 m/minute. Taking into account process stability, the winding speed is more preferably from 2,700 to 4,500 m/minute.

In the method for producing a polyester monofilament according to an embodiment of the present invention, any appropriate finishing agent (oil) is preferably applied to improve the smoothness, wear resistance, or anti-static properties of the polyester monofilament to be obtained in any part of the process. The oiling method may be an oiling guide method, an oiling roll method, a spray method, or the like, and oiling may be performed plural times between spinning and winding.

Figure 2:
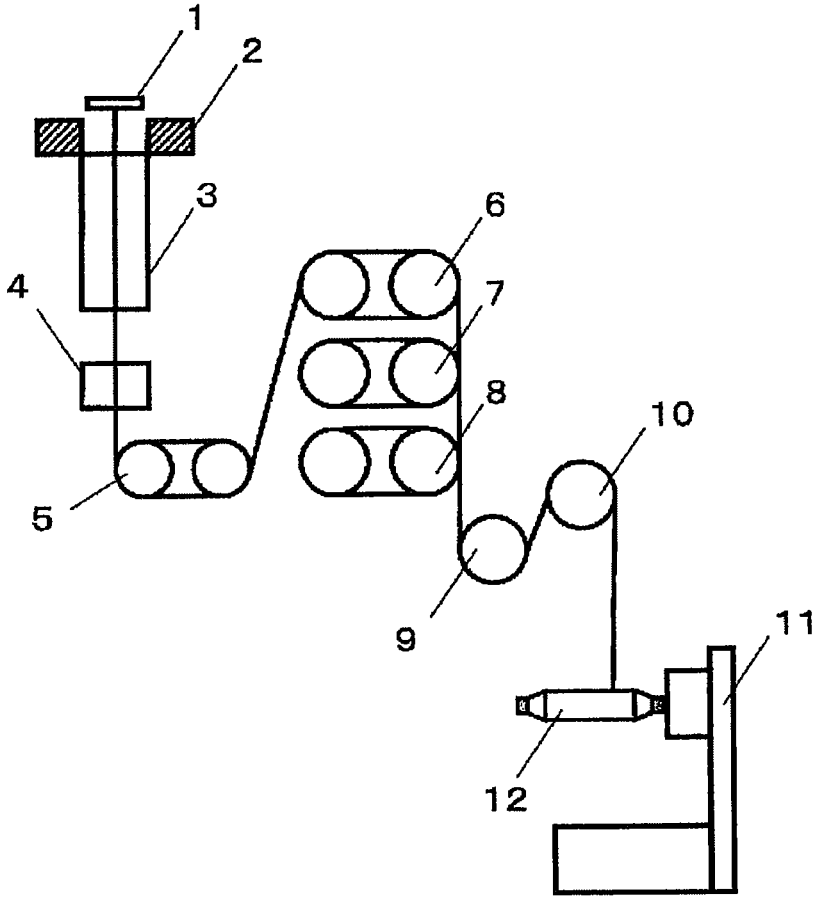
FIG. 2 is a schematic diagram showing an example of the yarn-making process for use in an embodiment of the present invention and showing a direct spinning-drawing apparatus used in examples of the present invention.

FIG. 2 is a side view showing an example of the yarn-making process (direct spinning-drawing method) for use in an embodiment of the present invention.

Referring to FIG. 2, a yarn discharged from a spinneret (1) is cooled and then supplied with oil by an oiling apparatus (4). Subsequently, the yarn is taken over by non-heated first godet rolls (5), preheated on first hot rolls (6) with a mirror surface while being wound by several turns thereon, and then drawn between first hot rolls (6) and second hot rolls (7). Subsequently, the yarn is drawn between second hot rolls (7) and third hot rolls (8). The yarn is further wound by several turns on the third hot rolls (8) to be thermoset and taken over by godet rolls (9) and (10). The thermoset yarn is cooled and undergoes tension control on the godet rolls (9) and (10) and then wound into a package (12). In the winder, the package winding tension is controlled by controlling the number of revolutions of the spindle on which the package (12) is mounted.

EXAMPLES

Hereinafter, the polyester monofilament of the present invention is more specifically described with reference to Examples. In the examples, the measured values were obtained by the methods described below.

(1) Intrinsic Viscosity (IV)

Concerning ηr in the definitional formula below, 0.8 g of the sample polymer was dissolved in 10 mL of o-chlorophenol (hereinafter abbreviated as OCP) with a purity of 98% or more at a temperature of 25° C., and the relative viscosity ηr was determined from the formula below using an Ostwald viscometer at a temperature 25° C., and the intrinsic viscosity (IV) was calculated from the formula below.

$$\eta r=\eta/\eta_0=(t\times d)/(t_0\times d_0)$$

Intrinsic viscosity (IV)=0.0242ηr+0.2634, wherein

η: the viscosity of the polymer solution $\eta_0$:the viscosity of OCP t: the fall time (seconds) of the solution d: the density (g/cm$^3$) of the solution $t_0$: the fall time (seconds) of OCP $d_0$: the density (g/cm$^3$) of OCP.

(2) Fineness

After 500 m of the yarn was collected to forma hank, the fineness was defined as the product obtained by multiplying the weight (g) of the hank by 20.

(3) Breaking Strength (cN/dtex) and 10% Elongation Strength (Modulus) (cN/dtex)

The measurement was performed according to JIS L 1013 (1999) using TENSILON UCT-100 manufactured by ORIENTEC Co., LTD.

(4) Stress Difference (cN) During Wet Heat Shrinkage in Fiber Longitudinal Direction The measurement was performed under the measurement conditions shown below using Filament Thermal Analysis System (FTA-500 for short) manufactured by TORAY INDUSTRIES, INC.

Wet heat temperature: 100° C.
Fiber feed tension: 19.6 cN
Fiber feed rate: 10 m/minute
Measured fiber length: 400 m The shrinkage stress generated on the fiber by thermal shrinkage was continuously measured with a tension meter, and the difference between the maximum stress and the minimum stress was read out from the resulting chart.

(5) Residual Torque Value (Turns/m)

The polyester monofilament used as a measurement sample was folded in half in the form of the letter U using a pin as a supporting point in such a manner that no unraveling twist was applied or no twist detorsion occurred, and under an initial load of 0.1 cN/dtex, both upper ends of the filament were fixed in such a manner that the sample length was set at 1 m. A very low load of 0.4 cN/dtex was applied to the portion of the sample at the supporting pin. Subsequently, the supporting pin was removed from the measurement sample, and the sample was allowed to twist by itself while it was suspended. After the self-twisting stopped, the filament was subjected to twist counting, and the torque value was defined as the number of the twists measured. The measurement was performed 10 times on the same sample, and the average was calculated and expressed in units of "twists/m." The measurement was performed in the atmosphere at a temperature of 20° C. and a relative humidity of 65%.

(6) Processability (Yarn-Making Ability)

Continuous spinning was performed for 168 hours (7 days) using a direct spinning-drawing machine with 32 spindles, and the yarn-making ability (yarn breakage rate) was evaluated on the following four scales.

○○: The yarn breakage rate is less than 3.0%.
○: The yarn breakage rate is from 3.0% to less than 5.0%.
Δ: The yarn breakage rate is from 5.0% to less than 7.0%.
x: The yarn breakage rate is 7.0% or more.

The acceptable level is a scale of ○ or higher.

(7) Quality of Screen Mesh cloths

A screen mesh cloth (400 mesh) with a warp density of 400 yarns/2.54 cm and a weft density of 400 yarns/2.54 cm was woven using warp and weft yarns of polyester monofilaments obtained in each of the examples and the comparative examples, in a sulzer weaving machine at a number of revolutions of 200/minute.

The resulting screen mesh cloths were each fed at a speed of 2 m/minute and visually inspected by skilled inspection engineers, who evaluated pirn barre and the quality of the mesh cloths according to the screen mesh cloth inspection code. Subsequently, 1,000 prints were produced, and the distortion of the printed pattern was observed with respect to dimensional stability. A total evaluation was performed using the following four scales.

○○: There is no defect such as pirn barre with respect to the mesh cloth quality, and the dimensional stability is very good.
○: There is no defect such as pirn barre with respect to the mesh cloth quality, and the dimensional stability is good.
Δ: There is no defect such as pirn barre with respect to the mesh cloth quality, but the dimensional stability is low; or the dimensional stability is good, but there is a defect such as pirn barre with respect to the mesh cloth quality.
x: There is a defect such as pirn barre with respect to the mesh cloth quality, and the dimensional stability is low.

The acceptable level is a scale of ○ or higher.

Examples 1 to 13 and Comparative Examples 1 to 16

In the examples and the comparative examples, polyester monofilaments were obtained by DSD method and two-step method under the production conditions shown in Tables 1 to 7, respectively. In the tables, HR represents hot roll, and GR represents godet roll.

Example 1

A core component of PET with an intrinsic viscosity of 1.00 (a polymer of terephthalic acid and ethylene glycol in Example 1) (80° C. in glass transition temperature) and a sheath component of PET with an intrinsic viscosity of 0.50 (a polymer of terephthalic acid and ethylene glycol in Example 1) were each melted at a temperature of 295° C. using an extruder. Subsequently, at a polymer temperature of 290° C., the core component and the sheath component were dispensed by pumping so that the bicomponent ratio (the core component/the sheath component) was 80:20, and fed into a known bicomponent spinneret so that a core-sheath type structure was formed. The pressure applied to the spinneret was 15 MPa with respect to each polymer. Each polymer passed through the piping in 15 minutes. The yarn discharged from the spinneret was subjected to spinning and drawing using the equipment shown in FIG. 2. Specifically, the polyester monofilament yarn discharged from the spinneret (1) was positively heated and kept at a certain temperature with a heater (2) in such a manner that the temperature of the atmosphere immediately below the spinneret was 290° C. Subsequently, the yarn was cooled with a yarn cooling blower (3) and supplied with a finishing agent by an oiling apparatus (4). The yarn was then taken over at a rate of 500 m/minute by non-heated first godet rolls (5). Without being wound temporarily, the yarn was taken over at a rate of 505 m/minute by first hot rolls (6) heated at a temperature of 90° C., taken over at a rate of 2,092 m/minute by second hot rolls (7) heated at a temperature of 90° C., and taken over at a rate of 2,929 m/minute by third hot rolls (8) heated at a temperature of 220° C., so that the yarn was drawn and thermoset. The yarn was further taken over at a rate of 2,944 m/minute and a rate of 2,958 m/minute by two non-heated godet rolls (9) and (10) with a surface roughness of 0.8 S, respectively. Subsequently, the yarn was wound into a package (12) in such a manner that the shape of the pirn satisfied Lt=0.2 L, while the winding tension was kept at 0.2 cN/dtex by controlling the number of spindle revolutions, so that a 6.0 dtex polyester monofilament was obtained. The results of the evaluation of the properties of the polyester monofilament were as shown in Table 1. Very high yarn-making ability and very high screen mesh cloth quality were obtained.

Example 2

A 10.0 dtex polyester monofilament was obtained as in Example 1, except that the fineness was changed by changing the discharge amount. The results of the evaluation of the properties of the resulting polyester monofilament were as shown in Table 1, and the yarn-making ability was very good as in Example 1.

Example 3

A 3.0 dtex polyester monofilament was obtained as in Example 1, except that the fineness was changed by changing the discharge amount. The results of the evaluation of the properties of the resulting polyester monofilament were as shown in Table 1.

Example 4

A 6.0 dtex polyester monofilament was obtained as in Example 1, except that the core component polyester (80° C. in glass transition temperature) had an intrinsic viscosity of 1.50. The results of the evaluation of the properties of the resulting polyester monofilament were as shown in Table 1.

Example 5

A 6.0 dtex polyester monofilament was obtained as in Example 1, except that the core component polyester (80° C. in glass transition temperature) had an intrinsic viscosity of 0.80 and that the discharge amount, each roll speed, and the third hot roll temperature were changed so that the total draw ratio was 4.2 times and the relax ratio was 1.4% between the third hot roll and the second godet roll. The results of the evaluation of the properties of the resulting polyester monofilament were as shown in Table 1, and the yarn-making ability was very good as in Example 1.

Example 6

A 6.0 dtex polyester monofilament was obtained as in Example 1, except that the discharge amount and each roll speed were changed so that the total draw ratio was 6.8 times. The results of the evaluation of the properties of the resulting polyester monofilament were as shown in Table 2.

Example 7

A 6.0 dtex polyester monofilament was obtained as in Example 1, except that the discharge amount, each roll speed, and the third hot roll temperature were changed so that the total draw ratio was 4.6 times and the relax ratio was 5.0% between the third hot roll and the second godet roll. The results of the evaluation of the properties of the resulting polyester monofilament were as shown in Table 2, and the yarn-making ability was very good as in Example 1.

Example 8

A 6.0 dtex polyester monofilament was obtained as in Example 1, except that the discharge amount and each roll speed were changed so that the relax ratio was −1.5% between the third hot roll and the second godet roll. The results of the

TABLE 1

| | | Example 1 | Example 2 | Example 3 | Example 4 | Example 5 |
|---|---|---|---|---|---|---|
| High-viscosity component (core component) | Polyester type | PET | PET | PET | PET | PET |
| | Intrinsic viscosity | 1.00 | 1.00 | 1.00 | 1.50 | 0.80 |
| Low-viscosity component (sheath component) | Polyester type | PET | PET | PET | PET | PET |
| | Intrinsic viscosity | 0.50 | 0.50 | 0.50 | 0.50 | 0.50 |
| Bicomponent ratio | Core component:sheath component | 80:20 | 80:20 | 80:20 | 80:20 | 80:20 |
| Atmosphere temperature (° C.) immediately below spinneret | | 290 | 290 | 290 | 290 | 290 |
| First GR | Speed (m/minute) | 500 | 500 | 500 | 500 | 800 |
| First HR | Temperature (° C.) | 90 | 90 | 90 | 90 | 90 |
| | Speed (m/minute) | 505 | 505 | 505 | 505 | 805 |
| Second HR | Temperature (° C.) | 90 | 90 | 90 | 90 | 90 |
| | Speed (m/minute) | 2092 | 2092 | 2092 | 2092 | 2400 |
| Third HR | Temperature (° C.) | 220 | 220 | 220 | 220 | 130 |
| | Speed (m/minute) | 2929 | 2929 | 2929 | 2929 | 3360 |
| Second GR | Speed (m/minute) | 2944 | 2944 | 2944 | 2944 | 3313 |
| | Surface roughness | 0.8S | 0.8S | 0.8S | 0.8S | 0.8S |
| Third GR | Speed (m/minute) | 2958 | 2958 | 2958 | 2958 | 3328 |
| | Surface roughness | 0.8S | 0.8S | 0.8S | 0.8S | 0.8S |
| Draw ratio (times) | | 5.8 | 5.8 | 5.8 | 5.8 | 4.2 |
| Rx ratio (%) | | −0.5 | −0.5 | −0.5 | −0.5 | 1.4 |
| Winding tension (cN/dtex) | | 0.2 | 0.2 | 0.2 | 0.2 | 0.2 |
| Fineness (dtex) | | 6.0 | 10.0 | 3.0 | 6.0 | 6.0 |
| Breaking strength (cN/dtex) | | 8.9 | 8.8 | 9.0 | 8.8 | 6.3 |
| 10% elongation strength (cN/dtex) | | 8.6 | 8.5 | 8.6 | 8.6 | 5.5 |
| Residual torque value (twists/m) | | 1 | 1 | 1 | 1 | 1 |
| Wet-heat stress difference (cN) in fiber longitudinal direction | | 2.0 | 1.8 | 2.3 | 2.8 | 1.0 |
| Bobbin package | L [mm] | 350 | 350 | 350 | 350 | 350 |
| | Lt [mm] | 70 (0.2 L) | 70 (0.2 L) | 70 (0.2 L) | 70 (0.2 L) | 70 (0.2 L) |
| Yarn-making ability | | ○○ | ○○ | ○ | ○ | ○○ |
| Screen mesh cloth quality | | ○○ | ○ | ○ | ○ | ○ |

evaluation of the properties of the resulting polyester monofilament were as shown in Table 2.

Example 9

A 6.0 dtex polyester monofilament was obtained as in Example 1, except that the discharge amount and each roll speed were changed so that the relax ratio was 8.0% between the third hot roll and the second godet roll. The results of the evaluation of the properties of the resulting polyester monofilament were as shown in Table 2, and the yarn-making ability was very good as in Example 1.

TABLE 2

| | | Example 6 | Example 7 | Example 8 | Example 9 |
|---|---|---|---|---|---|
| High-viscosity component (core component) | Polyester type | PET | PET | PET | PET |
| | Intrinsic viscosity | 1.00 | 1.00 | 1.00 | 1.00 |
| Low-viscosity component (sheath component) | Polyester type | PET | PET | PET | PET |
| | Intrinsic viscosity | 0.50 | 0.50 | 0.50 | 0.50 |
| Bicomponent ratio | Core component: sheath component | 80:20 | 80:20 | 80:20 | 80:20 |
| Atmosphere temperature (° C.) immediately below spinneret | | 290 | 290 | 290 | 290 |
| First GR | Speed (m/minute) | 500 | 1000 | 500 | 500 |
| First HR | Temperature (° C.) | 90 | 90 | 90 | 90 |
| | Speed (m/minute) | 505 | 1005 | 505 | 505 |
| Second HR | Temperature (° C.) | 90 | 90 | 90 | 90 |
| | Speed (m/minute) | 2489 | 2852 | 2092 | 2092 |
| Third HR | Temperature (° C.) | 220 | 200 | 220 | 220 |
| | Speed (m/minute) | 3434 | 4499 | 2929 | 2929 |
| Second GR | Speed (m/minute) | 3451 | 4285 | 2973 | 2712 |
| | Surface roughness | 0.8S | 0.8S | 0.8S | 0.8S |
| Third GR | Speed (m/minute) | 3467 | 4305 | 2987 | 2725 |
| | Surface roughness | 0.8S | 0.8S | 0.8S | 0.8S |
| Draw ratio (times) | | 6.8 | 4.6 | 5.8 | 5.8 |
| Rx ratio (%) | | −0.5 | 5.0 | −1.5 | 8.0 |
| Winding tension (cN/dtex) | | 0.2 | 0.2 | 0.2 | 0.2 |
| Fineness (dtex) | | 6.0 | 6.0 | 6.0 | 6.0 |
| Breaking strength (cN/dtex) | | 9.3 | 7.6 | 9.2 | 6.8 |
| 10% elongation strength (cN/dtex) | | 9.0 | 6.6 | 9.0 | 6.0 |
| Residual torque value (twists/m) | | 1 | 1 | 1 | 1 |
| Wet-heat stress difference (cN) in fiber longitudinal direction | | 2.8 | 1.3 | 3.0 | 0.8 |
| Bobbin package | L [mm] | 350 | 350 | 350 | 350 |
| | Lt [mm] | 70 (0.2 L) | 70 (0.2 L) | 70 (0.2 L) | 70 (0.2 L) |
| Yarn-making ability | | ○ | ○○ | ○ | ○○ |
| Screen mesh cloth quality | | ○ | ○ | ○ | ○ |

Example 10

A 6.0 dtex polyester monofilament was obtained as in Example 1, except that the package was formed by the winding so that the shape of the pirn satisfied Lt=0.4 L. The results of the evaluation of the properties of the resulting polyester monofilament were as shown in Table 3, and the yarn-making ability was very good as in Example 1.

Example 11

A 6.0 dtex polyester monofilament was obtained as in Example 1, except that the package was formed by the winding so that the shape of the pirn satisfied Lt=0.1 L. The results of the evaluation of the properties of the resulting polyester monofilament were as shown in Table 3. The screen mesh cloth quality was very good as in Example 1.

Example 12

A 6.0 dtex polyester monofilament was obtained as in Example 1, except that the number of spindle revolutions was controlled in the winding so that the winding tension was 0.4 cN/dtex. The results of the evaluation of the properties of the resulting polyester monofilament were as shown in Table 3, and the yarn-making ability was very good as in Example 1.

Example 13

A 6.0 dtex polyester monofilament was obtained as in Example 1, except that the number of spindle revolutions was controlled in the winding so that the winding tension was 0.1 cN/dtex. The results of the evaluation of the properties of the resulting polyester monofilament were as shown in Table 3. The screen mesh cloth quality was very good as in Example 1.

TABLE 3

| | | Example 10 | Example 11 | Example 12 | Example 13 |
|---|---|---|---|---|---|
| High-viscosity component (core component) | Polyester type | PET | PET | PET | PET |
| | Intrinsic viscosity | 1.00 | 1.00 | 1.00 | 1.00 |
| Low-viscosity component (sheath component) | Polyester type | PET | PET | PET | PET |
| | Intrinsic viscosity | 0.50 | 0.50 | 0.50 | 0.50 |
| Bicomponent ratio | Core component: sheath component | 80:20 | 80:20 | 80:20 | 80:20 |
| Atmosphere temperature (° C.) immediately below spinneret | | 290 | 290 | 290 | 290 |
| First GR | Speed (m/minute) | 500 | 500 | 500 | 500 |
| First HR | Temperature (° C.) | 90 | 90 | 90 | 90 |
| | Speed (m/minute) | 505 | 505 | 505 | 505 |
| Second HR | Temperature (° C.) | 90 | 90 | 90 | 90 |
| | Speed (m/minute) | 2092 | 2092 | 2092 | 2092 |
| Third HR | Temperature (° C.) | 220 | 220 | 220 | 220 |
| | Speed (m/minute) | 2929 | 2929 | 2929 | 2929 |
| Second GR | Speed (m/minute) | 2944 | 2944 | 2944 | 2944 |
| | Surface roughness | 0.8S | 0.8S | 0.8S | 0.8S |
| Third GR | Speed (m/minute) | 2958 | 2958 | 2958 | 2958 |
| | Surface roughness | 0.8S | 0.8S | 0.8S | 0.8S |
| Draw ratio (times) | | 5.8 | 5.8 | 5.8 | 5.8 |
| Rx ratio (%) | | −0.5 | −0.5 | −0.5 | −0.5 |
| Winding tension (cN/dtex) | | 0.2 | 0.2 | 0.4 | 0.1 |
| Fineness (dtex) | | 6.0 | 6.0 | 6.0 | 6.0 |
| Breaking strength (cN/dtex) | | 8.9 | 8.9 | 8.9 | 8.8 |
| 10% elongation strength (cN/dtex) | | 8.6 | 8.6 | 8.7 | 8.5 |
| Residual torque value (twists/m) | | 1 | 1 | 1 | 1 |
| Wet-heat stress difference (cN) in fiber longitudinal direction | | 2.6 | 1.8 | 2.5 | 1.5 |
| Bobbin package | L [mm] | 350 | 350 | 350 | 350 |
| | Lt [mm] | 140 (0.4 L) | 35 (0.1 L) | 70 (0.2 L) | 70 (0.2 L) |
| Yarn-making ability | | ○○ | ○ | ○○ | ○ |
| Screen mesh cloth quality | | ○ | ○○ | ○ | ○○ |

Comparative Example 1

A 15.0 dtex polyester monofilament was obtained as in Example 1, except that the fineness was changed by changing the discharge amount. The results of the evaluation of the properties of the resulting polyester monofilament were as shown in Table 4.

Comparative Example 2

A 2.0 dtex polyester monofilament was obtained as in Example 1, except that the fineness was changed by changing the discharge amount. The results of the evaluation of the properties of the resulting polyester monofilament were as shown in Table 4. The yarn-making ability was poor, because the fineness was very small.

Comparative Example 3

A 6.0 dtex polyester monofilament was obtained as in Example 1, except that the core component polyester had an intrinsic viscosity of 2.50. The results of the evaluation of the properties of the resulting polyester monofilament were as shown in Table 4. The yarn-making ability was poor, because the intrinsic viscosity was high so that the spinning tension was too high.

Comparative Example 4

A 6.0 dtex polyester monofilament was obtained as in Example 1, except that the core component polyester had an intrinsic viscosity of 0.50, the sheath component polyester had an intrinsic viscosity of 0.30, and the discharge amount, each roll speed, and the third hot roll temperature were changed so that the total draw ratio was 4.2 times and the relax ratio was 1.4% between the third hot roll and the second godet roll. The results of the evaluation of the properties of the resulting polyester monofilament were as shown in Table 4. Since the intrinsic viscosity of both components was low, the yarn had very low strength, and the yarn-making ability was poor.

Comparative Example 5

A 6.0 dtex polyester monofilament was obtained as in Example 1, except that the discharge amount and each roll speed were changed so that the total draw ratio was 7.5 times. The results of the evaluation of the properties of the resulting polyester monofilament were as shown in Table 4.

TABLE 4

| | | Comparative Example 1 | Comparative Example 2 | Comparative Example 3 | Comparative Example 4 | Comparative Example 5 |
|---|---|---|---|---|---|---|
| High-viscosity component (core component) | Polyester type | PET | PET | PET | PET | PET |
| | Intrinsic viscosity | 1.00 | 1.00 | 2.50 | 0.50 | 1.00 |
| Low-viscosity component (sheath component) | Polyester type | PET | PET | PET | PET | PET |
| | Intrinsic viscosity | 0.50 | 0.50 | 1.00 | 0.30 | 0.50 |
| Bicomponent ratio | Core component:sheath component | 80:20 | 80:20 | 80:20 | 80:20 | 80:20 |
| Atmosphere temperature (° C.) immediately below spinneret | | 290 | 290 | 290 | 290 | 290 |
| First GR | Speed (m/minute) | 500 | 500 | 500 | 800 | 500 |
| First HR | Temperature (° C.) | 90 | 90 | 90 | 90 | 90 |
| | Speed (m/minute) | 505 | 505 | 505 | 805 | 505 |
| Second HR | Temperature (° C.) | 90 | 90 | 90 | 90 | 90 |
| | Speed (m/minute) | 2092 | 2092 | 2092 | 2400 | 2689 |
| Third HR | Temperature (° C.) | 220 | 220 | 220 | 130 | 220 |
| | Speed (m/minute) | 2929 | 2929 | 2929 | 3360 | 3787 |
| Second GR | Speed (m/minute) | 2944 | 2944 | 2944 | 3313 | 3806 |
| | Surface roughness | 0.8S | 0.8S | 0.8S | 0.8S | 0.8S |
| Third GR | Speed (m/minute) | 2958 | 2958 | 2958 | 3328 | 3824 |
| | Surface roughness | 0.8S | 0.8S | 0.8S | 0.8S | 0.8S |
| Draw ratio (times) | | 5.8 | 5.8 | 5.8 | 4.2 | 7.5 |
| Rx ratio (%) | | −0.5 | −0.5 | −0.5 | 1.4 | −0.5 |
| Winding tension (cN/dtex) | | 0.2 | 0.2 | 0.2 | 0.2 | 0.2 |
| Fineness (dtex) | | 15.0 | 2.0 | 6.0 | 6.0 | 6.0 |
| Breaking strength (cN/dtex) | | 8.5 | 9.2 | 8.5 | 3.5 | 9.5 |
| 10% elongation strength (cN/dtex) | | 8.0 | 9.0 | 8.3 | 2.0 | 9.2 |
| Residual torque value (twists/m) | | 1 | 1 | 1 | 1 | 1 |
| Wet-heat stress difference (cN) in fiber longitudinal direction | | 1.8 | 2.3 | 3.2 | 0.5 | 3.2 |
| Bobbin package | L [mm] | 350 | 350 | 350 | 350 | 350 |
| | Lt [mm] | 70 (0.2 L) | 70 (0.2 L) | 70 (0.2 L) | 70 (0.2 L) | 70 (0.2 L) |
| Yarn-making ability | | ○○ | X | X | X | Δ |
| Screen mesh cloth quality | | Δ | Δ | Δ | Δ | Δ |

Comparative Example 6

A 6.0 dtex polyester monofilament was obtained as in Example 1, except that the discharge amount, each roll speed, and the third hot roll temperature were changed so that the total draw ratio was 3.5 times and the relax ratio was 5.0% between the third hot roll and the second godet roll. The results of the evaluation of the properties of the resulting polyester monofilament were as shown in Table 5.

Comparative Example 7

A 6.0 dtex polyester monofilament was obtained as in Example 1, except that the discharge amount and each roll speed were changed so that the relax ratio was −2.5% between the third hot roll and the second godet roll. The results of the evaluation of the properties of the resulting polyester monofilament were as shown in Table 5. Since the tension between the third hot roll and the second godet roll was too high, the yarn-making ability was poor.

Comparative Example 8

A 6.0 dtex polyester monofilament was obtained as in Example 1, except that the discharge amount and each roll speed were changed so that the relax ratio was 10.0% between the third hot roll and the second godet roll. The results of the evaluation of the properties of the resulting polyester monofilament were as shown in Table 5.

Comparative Example 9

A 6.0 dtex polyester monofilament was obtained as in Example 1, except that the package was formed by the winding so that the shape of the pirn satisfied Lt=0.6 L. The results of the evaluation of the properties of the resulting polyester monofilament were as shown in Table 5.

Comparative Example 10

A 6.0 dtex polyester monofilament was obtained as in Example 1, except that the package was formed by the winding so that the shape of the pirn satisfied Lt=0.04 L. The results of the evaluation of the properties of the resulting polyester monofilament were as shown in Table 5.

TABLE 5

| | | Comparative Example 6 | Comparative Example 7 | Comparative Example 8 | Comparative Example 9 | Comparative Example 10 |
|---|---|---|---|---|---|---|
| High-viscosity component (core component) | Polyester type | PET | PET | PET | PET | PET |
| | Intrinsic viscosity | 1.00 | 1.00 | 1.00 | 1.00 | 1.00 |
| Low-viscosity component (sheath component) | Polyester type | PET | PET | PET | PET | PET |
| | Intrinsic viscosity | 0.50 | 0.50 | 0.50 | 0.50 | 0.50 |
| Bicomponent ratio | Core component:sheath component | 80:20 | 80:20 | 80:20 | 80:20 | 80:20 |
| Atmosphere temperature (° C.) immediately below spinneret | | 290 | 290 | 290 | 290 | 290 |
| First GR | Speed (m/minute) | 1000 | 500 | 500 | 500 | 500 |
| First HR | Temperature (° C.) | 90 | 90 | 90 | 90 | 90 |
| | Speed (m/minute) | 1005 | 505 | 505 | 505 | 505 |
| Second HR | Temperature (° C.) | 90 | 90 | 90 | 90 | 90 |
| | Speed (m/minute) | 2497 | 2092 | 2092 | 2092 | 2092 |
| Third HR | Temperature (° C.) | 200 | 220 | 220 | 220 | 220 |
| | Speed (m/minute) | 3518 | 2929 | 2929 | 2929 | 2929 |
| Second GR | Speed (m/minute) | 3350 | 3002 | 2663 | 2944 | 2944 |
| | Surface roughness | 0.8S | 0.8S | 0.8S | 0.8S | 0.8S |
| Third GR | Speed (m/minute) | 3366 | 3016 | 2675 | 2958 | 2958 |
| | Surface roughness | 0.8S | 0.8S | 0.8S | 0.8S | 0.8S |
| Draw ratio (times) | | 3.5 | 5.8 | 5.8 | 5.8 | 5.8 |
| Rx ratio (%) | | 5.0 | −2.5 | 10.0 | −0.5 | −0.5 |
| Winding tension (cN/dtex) | | 0.2 | 0.2 | 0.2 | 0.2 | 0.2 |
| Fineness (dtex) | | 6.0 | 6.0 | 6.0 | 6.0 | 6.0 |
| Breaking strength (cN/dtex) | | 5.8 | 9.3 | 6.3 | 8.9 | 8.9 |
| 10% elongation strength (cN/dtex) | | 4.8 | 9.1 | 4.8 | 8.6 | 8.6 |
| Residual torque value (twists/m) | | 1 | 1 | 1 | 1 | 1 |
| Wet-heat stress difference (cN) in fiber longitudinal direction | | 1.0 | 3.5 | 0.8 | 3.2 | 1.5 |
| Bobbin package | L [mm] | 350 | 350 | 350 | 350 | 350 |
| | Lt [mm] | 70 (0.2 L) | 70 (0.2 L) | 70 (0.2 L) | 200 (0.6 L) | 15 (0.04 L) |
| Yarn-making ability | | ○○ | X | ○○ | ○○ | Δ |
| Screen mesh cloth quality | | Δ | Δ | Δ | Δ | ○○ |

Comparative Example 11

A 6.0 dtex polyester monofilament was obtained as in Example 1, except that the number of spindle revolutions was controlled in the winding so that the winding tension was 0.5 cN/dtex. The results of the evaluation of the properties of the resulting polyester monofilament were as shown in Table 6.

Comparative Example 12

A 6.0 dtex polyester monofilament was obtained as in Example 1, except that the number of spindle revolutions was controlled in the winding so that the winding tension was 0.05 cN/dtex. The results of the evaluation of the properties of the resulting polyester monofilament were as shown in Table 6. The yarn-making ability was poor, because the winding tension was very low so that the running of the yarn on the rolls was unstable.

Comparative Example 13

In Comparative Example 13, a 6.0 dtex polyester monofilament was obtained as in Example 1, except that only one non-heated godet roll was provided downstream of the third hot roll. The results of the evaluation of the properties of the resulting polyester monofilament were as shown in Table 6.

Comparative Example 14

An experiment was performed under the production conditions shown in Table 4 using a modified version of the production method of Example 1 in JP-A No. 05-295617.

PET with an intrinsic viscosity of 1.00 (a polymer of terephthalic acid and ethylene glycol in Comparative Example 14) and PET with an intrinsic viscosity of 0.50 (a polymer of terephthalic acid and ethylene glycol in Comparative Example 14) were each melted at a temperature of 295° C. using an extruder. Subsequently, at a polymer temperature of 290° C., the core component and the sheath component were dispensed by pumping so that the bicomponent ratio (the core component/the sheath component) was 80:20, and fed into a known bicomponent spinneret so that a core-sheath type structure was formed. The pressure applied to the spinneret was 15 MPa with respect to each polymer. Each polymer passed through the piping in 15 minutes.

Figure 3:
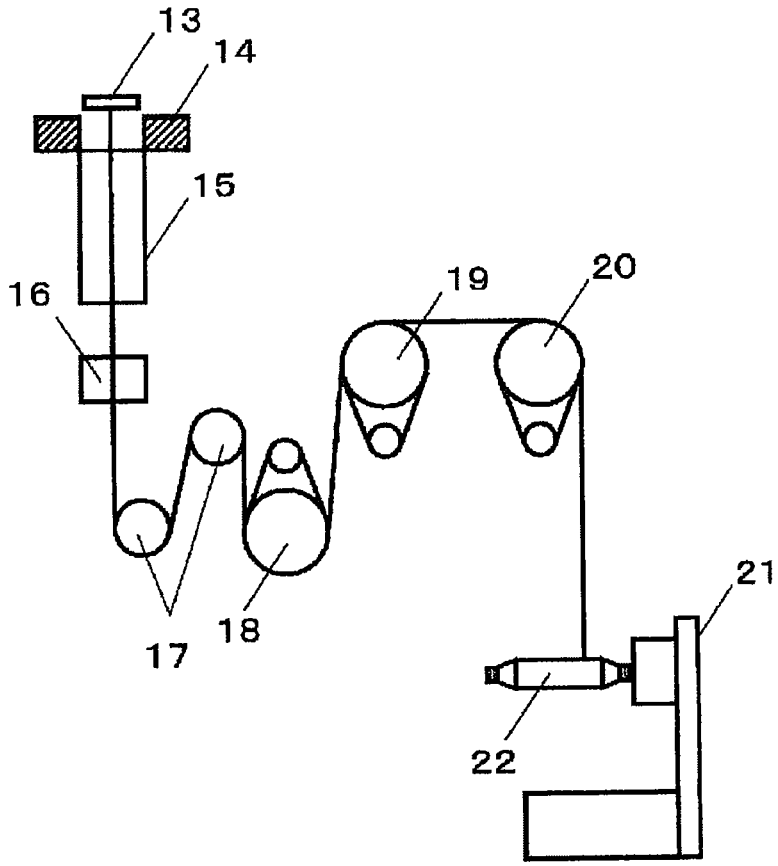
FIG. 3 is a schematic diagram of a drawing apparatus used in a comparative example.

The yarn discharged from the spinneret was subjected to spinning and drawing using the equipment shown in FIG. 3. Specifically, the yarn discharged from the spinneret (13) was positively heated and kept at a certain temperature with a heater (14) in such a manner that the temperature of the atmosphere immediately below the spinneret was 290° C. Subsequently, the yarn was cooled with a yarn cooling blower (15) and supplied with a finishing agent by an oiling apparatus (16). The yarn was then taken over at a rate of 1,200 m/minute by non-heated first godet rolls (17). Without being wound temporarily, the yarn was taken over at a rate of 1,205 m/minute by a first hot roll (18) heated at a temperature of 92° C., taken over at a rate of 3,950 m/minute by a second hot roll (19) heated at a temperature of 135° C., so that the yarn was drawn and thermoset. The yarn was further taken over at a rate of 4,050 m/minute by a non-heated godet roll (20) with a surface roughness of 0.8 S, and then wound into a package (22) in such a manner that the shape of the pirn satisfied Lt=0.2 L, while the winding tension was kept at 0.2 cN/dtex by controlling the number of spindle revolutions, so that a 6.0 dtex polyester monofilament was obtained. The results of the evaluation of the properties of the polyester monofilament were as shown in Table 6. Concerning the screen mesh cloth quality, the strength was low, and specifically, the dimensional stability of the screen mesh cloth was low, because one-step drawing was performed at a low draw ratio. Since the relaxation between the second hot roll and the godet roll was not enough, the residual stress was high, and pirn barre became more likely to occur, so that the quality was degraded.

TABLE 6

| | | Comparative Example 11 | Comparative Example 12 | Comparative Example 13 | Comparative Example 14 |
|---|---|---|---|---|---|
| High-viscosity component (core component) | Polyester type | PET | PET | PET | PET |
| | Intrinsic viscosity | 1.00 | 1.00 | 1.00 | 1.00 |
| Low-viscosity component (sheath component) | Polyester type | PET | PET | PET | PET |
| | Intrinsic viscosity | 0.50 | 0.50 | 0.50 | 0.50 |
| Bicomponent ratio | Core component: sheath component | 80:20 | 80:20 | 80:20 | 80:20 |
| Atmosphere temperature (° C.) immediately below spinneret | | 290 | 290 | 290 | 290 |
| First GR | Speed (m/minute) | 500 | 500 | 500 | 1200 |
| First HR | Temperature (° C.) | 90 | 90 | 90 | 92 |
| | Speed (m/minute) | 505 | 505 | 505 | 1205 |
| Second HR | Temperature (° C.) | 90 | 90 | 90 | 135 |
| | Speed (m/minute) | 2092 | 2092 | 2092 | 3950 |
| Third HR | Temperature (° C.) | 220 | 220 | 220 | — |
| | Speed (m/minute) | 2929 | 2929 | 2929 | — |
| Second GR | Speed (m/minute) | 2944 | 2944 | 2944 | 4050 |
| | Surface roughness | 0.8S | 0.8S | 0.8S | 0.8S |
| Third GR | Speed (m/minute) | 2958 | 2958 | — | — |
| | Surface roughness | 0.8S | 0.8S | — | — |
| Draw ratio (times) | | 5.8 | 5.8 | 5.8 | 3.3 |
| Rx ratio (%) | | −0.5 | −0.5 | −0.5 | −2.5 |
| Winding tension (cN/dtex) | | 0.5 | 0.05 | 0.2 | 0.2 |
| Fineness (dtex) | | 6.0 | 6.0 | 6.0 | 6.0 |
| Breaking strength (cN/dtex) | | 8.9 | 8.0 | 6.5 | 5.5 |
| 10% elongation strength (cN/dtex) | | 8.8 | 7.5 | 4.5 | 4.8 |
| Residual torque value (twists/m) | | 1 | 1 | 1 | 1 |
| Wet-heat stress difference (cN) in fiber longitudinal direction | | 3.1 | 1.5 | 2.0 | 3.5 |

TABLE 6-continued

| | | Comparative Example 11 | Comparative Example 12 | Comparative Example 13 | Comparative Example 14 |
|---|---|---|---|---|---|
| Bobbin package | L [mm] | 350 | 350 | 350 | 350 |
| | Lt [mm] | 70 (0.2 L) | 70 (0.2 L) | 70 (0.2 L) | 70 (0.2 L) |
| Yarn-making ability | | Δ | X | Δ | Δ |
| Screen mesh cloth quality | | Δ | ○○ | Δ | X |

Comparative Example 15

An experiment was performed using a modified production method in each of Comparative Examples 15 and 16. A polyester monofilament was obtained by two-step method under the production conditions shown in Table 7.

Figure 4:
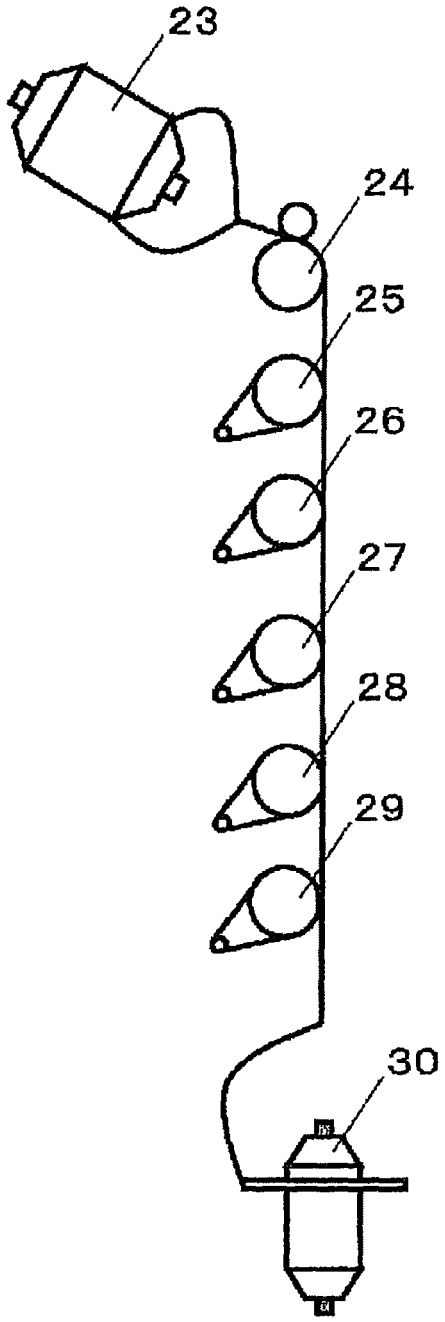
FIG. 4 is a schematic diagram of a drawing apparatus used in another comparative example.

In Comparative Example 15, PET with an intrinsic viscosity of 0.80 (a polymer of terephthalic acid and ethylene glycol in Comparative Example 15) (80° C. in glass transition temperature) and PET with an intrinsic viscosity of 0.50 (a polymer of terephthalic acid and ethylene glycol in Comparative Example 15) were each melted at a temperature of 295° C. using an extruder. Subsequently, at a polymer temperature of 290° C., the core component and the sheath component were dispensed by pumping so that the bicomponent ratio (the core component/the sheath component) was 80:20, and fed into a known bicomponent spinneret so that a core-sheath type structure was formed. The yarn was positively heated and kept at a certain temperature in such a manner that the temperature of the atmosphere immediately below the spinneret was 290° C., and spun at a spinning speed of 1,200 m/minute, so that a 24.5 dtex, core-sheath type, polyester monofilament undrawn yarn was obtained. After the undrawn yarn was aged at an environment temperature of 25° C. for 2 days, the drawing machine shown in FIG. 4 was used, which included a first hot roll (25) kept unheated, a second hot roll (26) heated at a temperature of 90° C., and a third hot roll (27) heated at a temperature of 130° C. The yarn was drawn at a draw ratio of 3.2 times and heat-treated between the second hot roll and the third hot roll. The yarn was then relaxed by 1.4% between the third hot roll and non-heated first and second godet rolls (28) and (29) with a surface roughness of 0.8 S, so that a 6.0 dtex polyester monofilament was obtained. The results of the evaluation of the properties of the polyester monofilament were as shown in Table 7.

Comparative Example 16

In Comparative Example 16, PET with an intrinsic viscosity of 1.00 (a polymer of terephthalic acid and ethylene glycol in Comparative Example 16) and PET with an intrinsic viscosity of 0.50 (a polymer of terephthalic acid and ethylene glycol in Comparative Example 16) were each melted at a temperature of 295° C. using an extruder. Subsequently, at a polymer temperature of 290° C., the core component and the sheath component were dispensed by pumping so that the bicomponent ratio (the core component/the sheath component) was 80:20, and fed into a known bicomponent spinneret so that a core-sheath type structure was formed. The yarn was positively heated and kept at a certain temperature in such a manner that the temperature of the atmosphere immediately below the spinneret was 290° C., and spun at a spinning speed of 1,000 m/minute, so that a 26.4 dtex, core-sheath-type, polyester monofilament undrawn yarn was obtained. After the undrawn yarn was aged at an environment temperature of 25° C. for 2 days, the drawing machine shown in FIG. 4 was used, which included a first hot roll (25) heated at a temperature of 90° C., a second hot roll (26) heated at a temperature of 90° C., and a third hot roll (27) heated at a temperature of 200° C. The yarn was drawn at a draw ratio of 2.9 times between the first hot roll and the second hot roll, and then further drawn at a draw ratio of 1.6 times and heat-treated between the second hot roll and the third hot roll (27) heated at a temperature of 200° C. The yarn was then relaxed by 5.0% between the third hot roll and non-heated first and second godet rolls (28) and (29) with a surface roughness of 0.8 S, so that a 6.0 dtex polyester monofilament was obtained. The results of the evaluation of the properties of the polyester monofilament were as shown in Table 7.

TABLE 7

| | | Comparative Example 15 | Comparative Example 16 |
|---|---|---|---|
| High-viscosity component (core component) | Polyester type | PET | PET |
| | Intrinsic viscosity | 0.80 | 1.00 |
| Low-viscosity component (sheath component) | Polyester type | PET | PET |
| | Intrinsic viscosity | 0.50 | 0.50 |
| Bicomponent ratio | Core component: sheath component | 80:20 | 80:20 |
| Atmosphere temperature (° C.) immediately below spinneret | | 290 | 290 |
| Spinning speed | | 1200 | 1000 |
| Supply roll | Speed (m/minute) | 220 | 182 |
| First HR | Temperature (° C.) | R.T. | 90 |
| | Speed (m/minute) | 220 | 182 |
| Second HR | Temperature (° C.) | 90 | 90 |
| | Speed (m/minute) | 220 | 532 |
| Third HR | Temperature (° C.) | 130 | 200 |
| | Speed (m/minute) | 913 | 840 |
| First GR | Temperature (° C.) | 900 | 800 |
| | Surface roughness | 0.8S | 0.8S |
| Second GR | Speed [m/minute] | 900 | 800 |
| | Surface roughness | 0.8S | 0.8S |
| Draw ratio (times) | | 4.2 | 4.6 |
| Rx ratio (%) | | 1.4 | 5.0 |
| Winding tension (cN/dtex) | | 0.5 | 0.5 |
| Fineness (dtex) | | 6.0 | 6.0 |
| Breaking strength (cN/dtex) | | 6.3 | 7.6 |
| 10% elongation strength (cN/dtex) | | 5.5 | 6.6 |
| Residual torque value (twists/m) | | 5 | 5 |
| Wet-heat stress difference (cN) in fiber longitudinal direction | | 4.0 | 5.0 |
| Bobbin package | L [mm] | 350 | 350 |
| | Lt [mm] | 70 (0.2 L) | 70 (0.2 L) |
| Yarn-making ability | | ○○ | ○○ |
| Screen mesh cloth quality | | Δ | Δ |

The polyester monofilament provided by the present invention and the screen mesh cloth obtained therefrom are particularly suitable for use in screen mesh cloth applications for precise printing.

The method for producing a polyester monofilament according to the present invention makes it possible to produce a polyester monofilament that is suitable for high-mesh screen cloths having excellent dimensional stability derived from high strength and high modulus, being free from such a problem as pirn Barre or snarl, having excellent quality, and being suitable for high-precision screen printing. The method for producing a polyester monofilament according to the present invention also provides a stable process in which yarn breakage is less likely to occur.

REFERENCE SIGNS LIST

L: Length of portion where yarn is wound in pirn
Lt: Length of tapered portion of pirn package
1: Spinneret
2 Heater
3 Yarn cooling blower apparatus
4 Oiling apparatus
5 First godet roll
6 First hot roll
7 Second hot roll
8 Third hot roll
9 Second godet roll
10 third godet roll
11 Yarn winding apparatus
12 Package
13 Spinneret
14 Heater
15 Yarn cooling blower apparatus
16 Oiling apparatus
17 First godet roll
18 First hot roll
19 Second hot roll
20 Second godet roll
21 Yarn winding apparatus
22 Package
23 Undrawn yarn
24 Supply roll
25 First hot roll
26 Second hot roll
27 Third hot roll
28 First godet roll
29 Second godet roll
30 Package

The invention claimed is:

1. A polyester monofilament, comprising a core component of a high-viscosity polyester and a sheath component of a low-viscosity polyester, which form a core-sheath type bicomponent structure; and having a fineness of 3.0 to 13.0 dtex, a breaking strength of 6.0 to 9.3 cN/dtex, a strength of 5.0 to 9.0 cN/dtex when elongated by 10%, a wet-heat stress difference of 3.0 cN or less in a fiber longitudinal direction, and a residual torque value of 4 twists/m or less, wherein the monofilament is produced by a direct spinning-drawing process including producing a core-sheath type composite from two components of a high-viscosity polyester for a core component and a low-viscosity polyester for a sheath component, extruding a melt of the composite from a spinneret, cooling the melt to solidify it, then continuously drawing the resulting undrawn yarn, and winding the yarn.

2. The polyester monofilament according to claim 1, wherein there is an intrinsic viscosity difference of 0.20 or more between the polyester in the sheath component and the polyester in the core component.

3. The polyester monofilament according to claim 1, wherein the core component/the sheath component bicomponent ratio is from 60:40 to 95:5.

4. A screen mesh cloth comprising the polyester monofilament according to claim 1.

* * * * *